US005609015A

United States Patent [19]

Raasch et al.

[11] Patent Number: 5,609,015

[45] Date of Patent: Mar. 11, 1997

[54] APPARATUS FOR CLEANING A ROTOR REVOLVING IN THE ROTOR HOUSING OF AN OPEN-END SPINNING UNIT

[75] Inventors: Hans Raasch; Helmuth Hensen, both of Mönchengladbach, Germany

[73] Assignee: W. Schlafhorst AG & Co., Moenchengladbach, Germany

[21] Appl. No.: 413,240

[22] Filed: Mar. 30, 1995

[30] Foreign Application Priority Data

Mar. 31, 1994 [DE] Germany ..... 44 11 343.9

[51] Int. Cl.[6] ..... D01H 11/00

[52] U.S. Cl. ..... 57/302

[58] Field of Search ..... 57/302

[56] References Cited

U.S. PATENT DOCUMENTS

| | | | |
|---|---|---|---|
| 4,339,914 | 7/1982 | Pfeifer | 57/302 |
| 4,897,993 | 2/1990 | Raasch et al. | 57/302 |

FOREIGN PATENT DOCUMENTS

| | | |
|---|---|---|
| 2618094 | 11/1977 | Germany . |
| 3313926 | 10/1984 | Germany . |
| 2629161 | 11/1986 | Germany . |
| 3715934 | 11/1988 | Germany . |
| 3911946 | 10/1990 | Germany . |

*Primary Examiner*—Michael R. Mansen
*Attorney, Agent, or Firm*—Herbert L. Lerner; Laurence A. Greenberg

[57] ABSTRACT

An open-end spinning unit includes a rotor housing and a rotor revolving in the rotor housing and having a fiber collecting groove formed therein defining a groove bottom. An apparatus for cleaning the rotor includes a cleaning device having a scraper to be positioned in a predetermined position in the fiber collecting groove of the rotor. The scraper automatically assumes an optimal length independently of its abrasion from wear upon entry of the cleaning device into the rotor, for assuring a secure placement of the scraper in the bottom of the fiber collecting groove.

9 Claims, 3 Drawing Sheets

1
2
3
4
5
8
9
10
11
12
13
14
15
16
17
18
19
20
21
22
23
24
24'
25
III
III 1
2
16
3
9
4
7
8
22
5
6

APPARATUS FOR CLEANING A ROTOR REVOLVING IN THE ROTOR HOUSING OF AN OPEN-END SPINNING UNIT

BACKGROUND OF THE INVENTION

FIELD OF THE INVENTION

The invention relates to an apparatus for cleaning a rotor revolving in a rotor housing of an open-end spinning unit, having a scraper that can be positioned in a fiber collecting groove of the rotor.

Such apparatuses are known from numerous publications.

German Published, Non-Prosecuted Application DE-OS 26 18 094 A1, for instance, describes a cleaning apparatus disposed in an automatic maintenance unit, which has a scraper element that is drivable into the spinning rotor and is adapted to the contour of the fiber collecting groove. The scraper element is secured to one end of a rod. The scraper element also has an injection device for a liquid cleaning agent. Through the use of such a device, the fiber collecting groove can be mechanically cleaned, and in addition a mixture of cleaning agent or detergent and air can be blown into the rotor.

A cleaning apparatus which was especially conceived of for small rotor diameters is known from German Published, Non-Prosecuted Application DE-OS 39 11 946 A1. The actual cleaning apparatus is disposed in a housing, which is positioned in front of the opened spinning box. A carrier is supported pivotably inside the housing, with its pivot axis being offset from the rotor axis and inclined at an acute angle. The carrier is given a three-dimensional shape in such a way that the end occupied by the cleaning tool, when rotated about the axis, describes a circular arc that intersects the plane of the fiber collecting groove of the rotor.

In a forward-oriented motion, the cleaning tool is moved through the rotor opening to the part of the rotor to be cleaned.

A cleaning device is also known from German Published, Non-Prosecuted Application DE 37 15 934 A1, corresponding to U.S. Pat. No. 4,897,993. Its scraper, which is disposed on the end of the piston rod of a pneumatic thrust piston mechanism, is movable in the direction of the fiber collecting groove into the rotor of an open-end spinning unit. The scraper has a knife-like end piece that extends into the fiber collecting groove and is bent in the plane of the knife in such a way that counter to the direction of rotation of the rotor, the front edge extends in inclined fashion counter to the direction of rotation of the rotor.

In both German Patent DE-PS 26 29 161 C2 and German Published, Non-Prosecuted Application DE 33 13 926 A1, cleaning devices for rotor spinning apparatuses are also described that have rotatably supported cleaning tools. Scraper inserts that are positioned at their ends on spiral springs are used as the cleaning tools. During the cleaning process, under the influence of centrifugal force, the revolving scraper inserts press into the rotor groove and clean it of any dirt particles adhering to it.

Since the position of the scraper inserts is radially adjustable because of their disposition on the elastic spiral springs, there is automatic compensation for abrasion from wear of the scraper inserts.

However, that kind of elastic support of the cleaning tools has the disadvantage of the danger that the scraper elements will not be positioned far enough forward, or will bounce back, if firmly adhering contamination is present. In those cases, perfect cleaning of the fiber collecting groove of the spinning rotor is not assured.

SUMMARY OF THE INVENTION

It is accordingly an object of the invention to provide an apparatus for cleaning a rotor revolving in a rotor housing of an open-end spinning unit, which overcomes the hereinafore-mentioned disadvantages of the heretofore-known devices of this general type.

With the foregoing and other objects in view there is provided, in accordance with the invention, an an open-end spinning unit including a rotor housing and a rotor revolving in the rotor housing and having a fiber collecting groove formed therein defining a groove bottom, an apparatus for cleaning the rotor, comprising a cleaning device having a scraper to be positioned in a predetermined position in the fiber collecting groove of the rotor, the scraper automatically assuming an optimal length independently of its abrasion from wear upon entry of the cleaning device into the rotor, for assuring a secure placement or contact of the scraper in the bottom of the fiber collecting groove.

An advantage of the embodiment of the scraper according to the invention is that the scraper automatically assumes an optimal length upon entry of the cleaning device into the rotor, which assures contact of the scraper with the bottom of the fiber collecting groove, regardless of any scraper abrasion from wear. This assures that the scraper remains equally effective from the first cleaning process to the last, regardless of the degree of soiling of the spinning rotor.

In accordance with another feature of the invention, the scraper is constructed as a strip-like wear part, so that the surface life of such cleaning devices can be prolonged markedly as compared with known devices. Since moreover the optimal length of the scraper strip is automatically readjusted upon its entry into the fiber collecting groove, control inspections by the operators can be dispensed with to the maximum extent or can be markedly reduced. Overall, the apparatus according to the invention makes the work of machine operators considerably easier.

In accordance with a further feature of the invention, the scraper strip is force-lockingly connected to a displacement device. A force-locking connection is one which connects two elements together by force external to the elements, as opposed to a form-locking connection which is provided by the shapes of the elements themselves. A pressure roller resting by spring force on the scraper strip generates just enough friction between the scraper strip and the driven feed roller of the displacement device to make the scraper strip come into adequately firm contact with the fiber collecting groove of the spinning rotor, or in other words to assure reliable cleaning of this critical region. On the other hand, once the scraper strip has come into contact inside the fiber collecting groove, the feed roller can slip freely beneath the scraper strip, so that excessive wear from an overly firm contact is averted.

Preferably, the displacement device for the scraper strip includes a feed roller that has a pivot lever, a spring-actuated pressure roller, and a pneumatic cylinder that is connected by a piston rod to the pivot lever. Upon extension and retraction of the piston rod, the feed roller is rotated clockwise and counterclockwise, respectively, and in so doing carries the scraper strip clamped between the feed roller and the pressure roller along with it by way of frictional engagement, in the applicable direction of rotation of the feed roller.

In accordance with an added feature of the invention, the feed motion of the scraper strip, initiated by the feed roller or the pneumatic cylinder, is limited by the contact of the tip of the strip in the fiber collecting groove. In other words, in the last stage of its rotation, the feed roller slips underneath the scraper strip, which has been optimally moved inward.

Such an embodiment on one hand assures that the scraper strip is inserted properly into the fiber collecting groove, and on the other hand the contact pressure of the tip of the strip against the fiber collecting groove wall is prevented from becoming too great.

In accordance with an additional feature of the invention, for the sake of satisfactory automatic readjustment, the feed path that the scraper strip covers upon the inward motion of the cleaning apparatus into the rotor is longer than the restoring path of the scraper strip when the cleaning device is withdrawn.

In accordance with yet another feature of the invention, there is provided a stroke limiter for this purpose, which is constructed in such a way that the scraper strip can pass the stroke limiter unhindered in the forward feed direction, while in the return direction it is clamped and therefore blocked in the stroke limiter after a certain path distance. In that case as well, the feed roller can slip unhindered under the scraper strip to reach its outset position.

In accordance with a concomitant feature of the invention, there is provided a sensor device in the outlet region of the scraper strip reservoir, the sensor detects when the strip-like wear part is becoming depleted, so that operators can intervene and put a new scraper strip in place at the proper time. In this way, maintenance unit down time or spinning unit malfunctions resulting from inadequate cleaning can be reliably avoided.

Other features which are considered as characteristic for the invention are set forth in the appended claims.

Although the invention is illustrated and described herein as embodied in an apparatus for cleaning a rotor revolving in a rotor housing of an open-end spinning unit, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

In the operation of open-end rotor spinning machines, it is customary to clean the rotor before restarting a spinning unit. In particular, the fiber collecting groove of the rotor must be cleaned of any fluff and other soil sticking to it, otherwise a proper outcome of spinning cannot be attained.

Maintenance units that patrol in the region of the spinning machines and automatically correct yarn breaks as they occur therefore have a cleaning device, by means of which cleaning of the rotor and in particular of its fiber collecting groove is possible.

Figure 1:
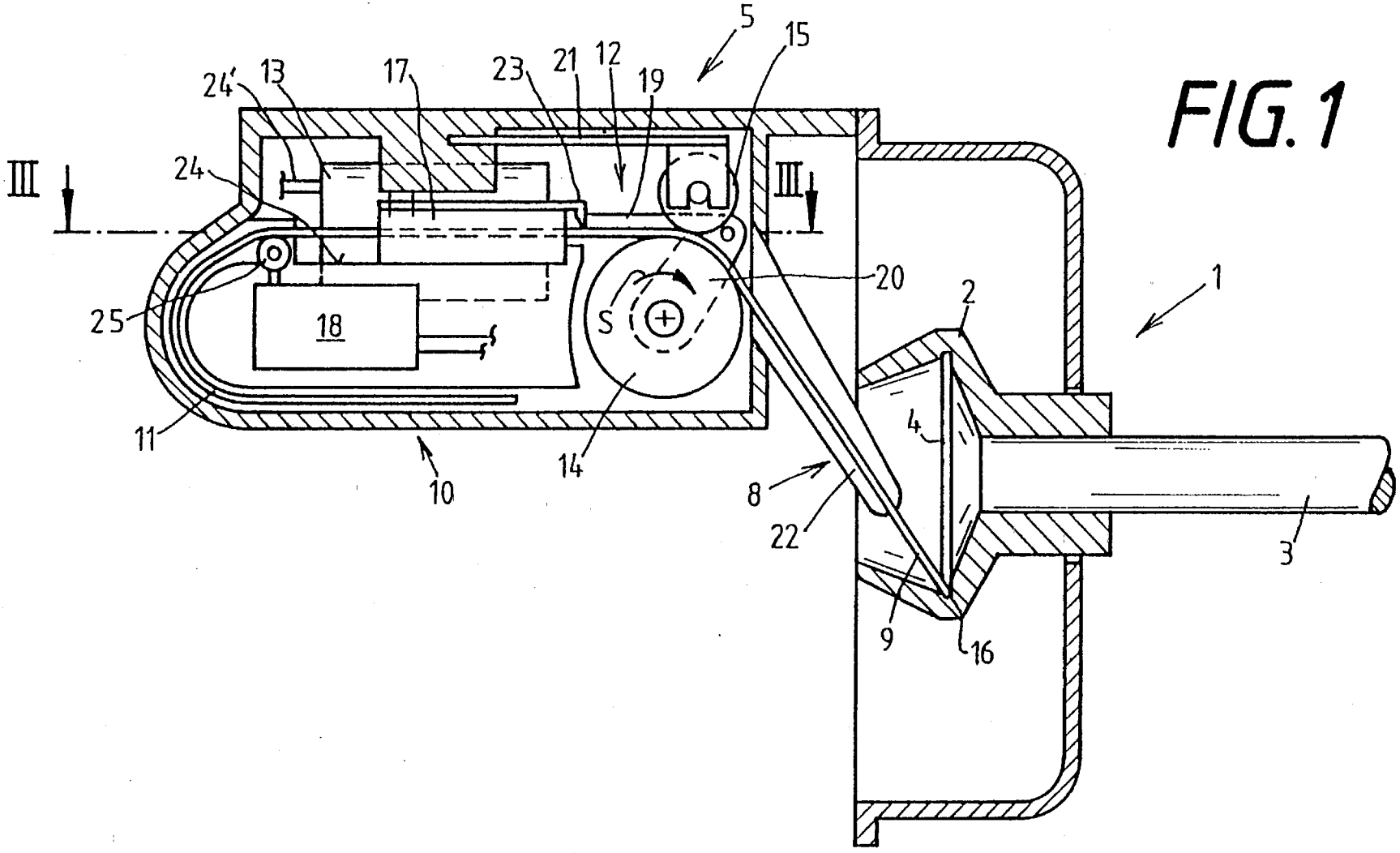
FIG. 1 is a fragmentary, diagrammatic, longitudinal-section view of a cleaning device positioned in front of an open-end rotor spinning unit.

Referring now to the figures of the drawing in detail and first, particularly, to FIG. 1 thereof, there is seen a cleaning head 5 of such a cleaning device, in a sectional view. The cleaning head 5 is positioned in front of an opened rotor housing 1 of an open-end rotor spinning unit. A spinning rotor 2 is disposed inside the rotor housing 1. The spinning rotor 2 is supported by a rotor shaft 3 on a rotor disk bearing in a manner which is known and is therefore not shown in detail herein, and the spinning rotor has a fiber collecting groove 4 in the region of its rotor head.

Figure 2:
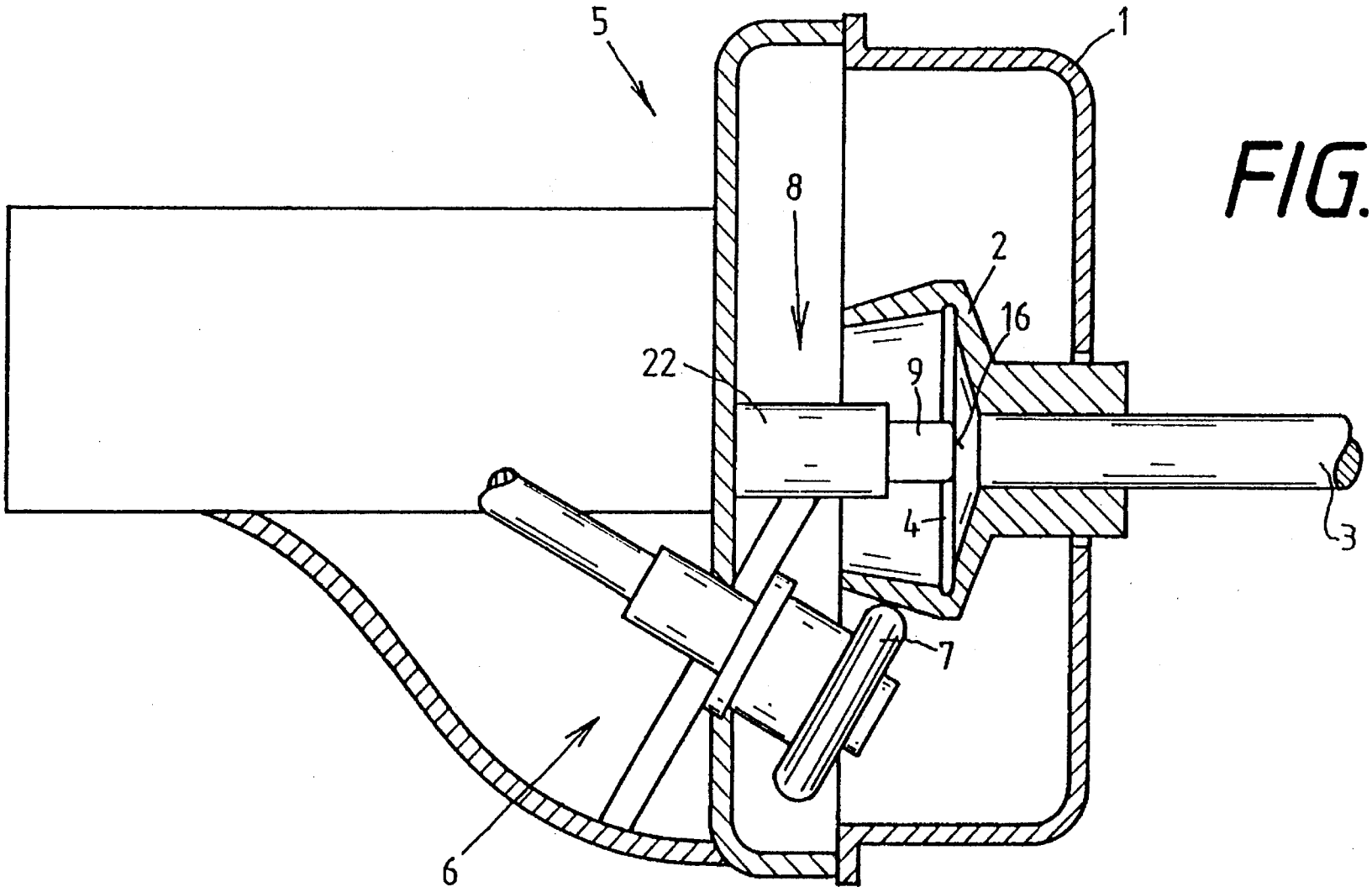
FIG. 2 is a plan view of the cleaning device shown in FIG. 1.

As is indicated in FIG. 2, the cleaning head 5 has a drive device 6, for example with a rubber-tired drive wheel 7, which can be positioned from the outside against the rotor head, and a cleaning device 8 seen in FIG. 1 that can be moved into the fiber collecting groove 4. The cleaning device 8 is constructed with a scraper 9 that can be moved outward in the direction of the fiber collecting groove 4. The scraper 9 includes a scraper strip 11, which is kept on hand in the reservoir 10 and can be moved outward or inward in the direction of the fiber collecting groove 4 by means of a displacement device 12.

In detail, the displacement device 12 includes a drive element in the form of a triggerable pneumatic cylinder 13, having a piston rod 19 which is connected to a pivot lever 20. The pivot lever 20 is in turn connected to a feed roller 14 in such a manner as to be fixed against relative rotation. Resting on the feed roller 14 is a pressure roller 15 which is loaded by a spring element 21. The scraper strip 11 is force-lockingly clamped between the feed roller 14 and the pressure roller 15, and upon extension of the piston rod 19 of the pneumatic cylinder 13 in the forward direction V shown in FIG. 3, the scraper strip is pushed outward in the direction of the fiber collecting groove 4. In order to adjust the contact pressure of the pressure roller 15, a non-illustrated adjusting element may be provided in the exemplary embodiment. An example of such an adjusting element is a pressure screw acting upon the spring element 21.

On the outlet side, the flexible, relatively thin scraper strip 11 is supported in a guide channel 22, so that drifting or kinking of the scraper strip 11 upon movement into the fiber collecting groove 4 is reliably prevented.

The fill level or the depletion of the scraper strip reservoir is monitored by a sensor device 18, which is disposed at the outlet of the reservoir. By way of example, the sensor device 18 may be constructed as an end switch, which rests with a small pressure roll on the scraper strip 11 and switches a contact if the scraper strip is absent.

The displacement device 12 furthermore has a stroke limiter 17, which is constructed in such a way that unhindered sliding of the scraper strip in the direction toward the fiber collecting groove 4 is permitted, while in the opposite direction the passage of the scraper strip is blocked by the stroke limiter. The stroke limiter 17 is in turn longitudinally movably supported in a guide 24 of the cleaning head 5 and its displacement path is the measure for the return course of the scraper strip 11. The stroke limiter 17 may take various forms. For instance, it is possible to prevent the sliding of the scraper strip in the return direction by using a clamp element 23. Such a clamp element may, for instance, be constructed as a wedge element, an eccentric roller, or the like.

The mode of operation of the cleaning apparatus is as follows:

As soon as the maintenance unit is positioned in front of a spinning unit and the spinning box is opened, the cleaning head 5 is put into position in front of the opened rotor housing 1. The pneumatic cylinder 13 is acted upon through a line 24', so that its piston rod 19 moves outward and shifts the pivot lever 20 in a direction S. As a result, the feed roller 14 which is connected to the pivot lever 20 in such a manner as to be fixed against relative rotation, is rotated clockwise, and the scraper strip 11 that is clamped between the feed roller 14 and the spring-actuated pressure roller 15 is force-lockingly pushed outward in the direction of the fiber collecting groove 4. The outward thrust path of the scraper strip 11 is limited by contact of a tip 16 of the strip in the fiber collecting groove 4. At the same time, the rotor 2 is rotated slowly by the drive device 6, or in other words by the drive wheel 7 resting on the outside of the rotor head, as is seen in FIG. 2. The material of the scraper strip 11 which, for example, is a relatively easily worn plastic, assures good conformance of the tip 16 of the strip to the shape of the fiber collecting groove, so that the entire fiber collecting groove is thus reliably cleaned.

Figure 3:
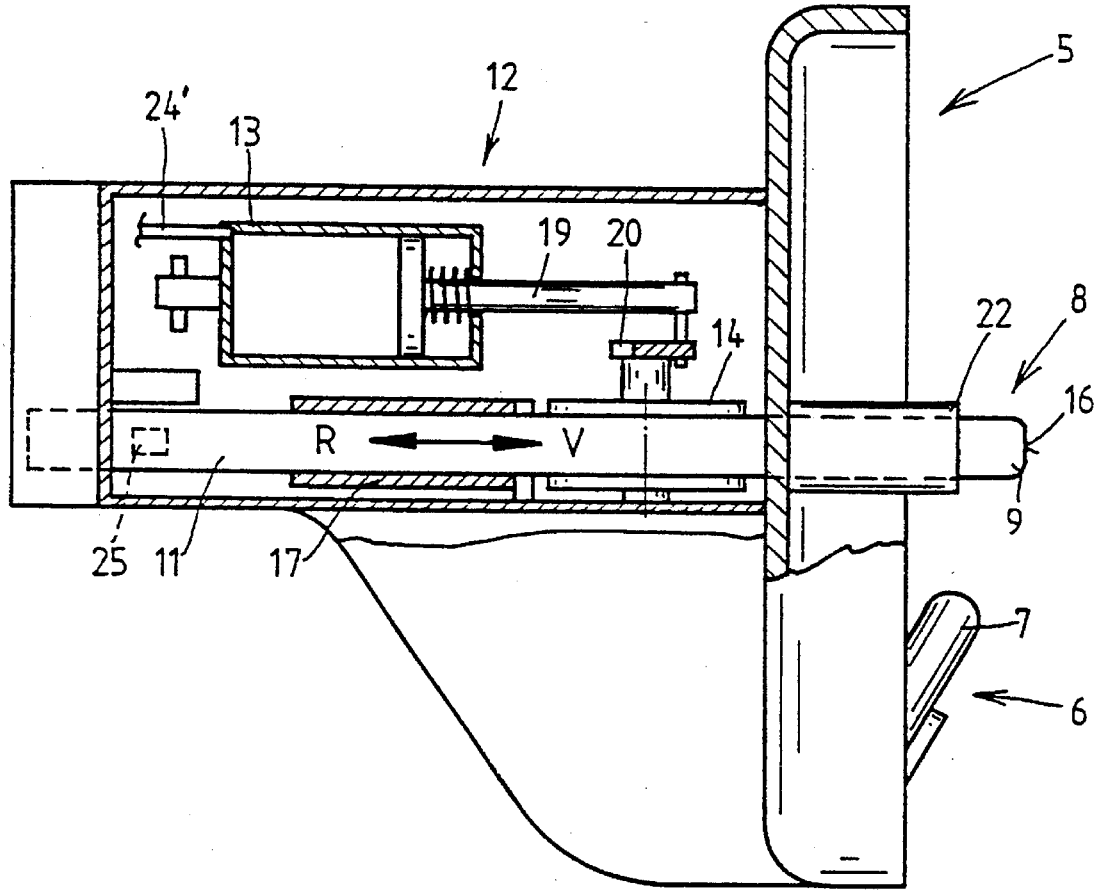
FIG. 3 is a partly broken-away plan view taken along a line III—III of FIG. 1, in the direction of the arrows.

Once the cleaning process has ended, the pneumatic cylinder 13 retracts the piston rod 19 in the reverse or return direction R shown in FIG. 3, and as a result the feed roller 14 is rotated counterclockwise. This means that the scraper strip 11 is retracted. The stroke limiter 17 assures that the retrieval path of the scraper strip 11 is shorter than its forward feed path. This assures that the shortening of the scraper strip caused by wear is automatically compensated for the next time the scraper strip is driven outward, and the optimal length is established when the scraper strip 11 is moved into the fiber collecting groove of the spinning rotor.

The sensor device 18 indicates the correct time at which the scraper strip 11 that is held in reserve in the scraper strip reservoir 10 has attained a length that makes it appear advisable to change the scraper strip soon. A sensor element 25 which is constructed as a pressure roller of the sensor 18 is shown in FIGS. 1 and 3. The pressure roller 25 initially lies against the scraper strip 11 from below and keeps a contact open in the sensor 18. When the scraper strip is worn out to such an extent that the pressure roller 25 is no longer in contact with the scraper strip 11, the contact in the sensor 18 is connected and a signal shows an operator that a scraper strip change will be necessary shortly.

The invention is not limited to the exemplary embodiment described above. Both in terms of the displacement device or its drive and in terms of the stroke limiter or the scraper strip reservoir, other embodiments which are not described in detail in the present application are also conceivable, without departing from the spirit and scope of the invention. What is essential to the invention is above all that upon entry of the cleaning device into the rotor, the optimal length of the scraper strip is automatically established.

We claim:

1. In an open-end spinning unit including a rotor housing and a rotor revolving in the rotor housing and having a fiber collecting groove formed therein defining a groove bottom, an apparatus for cleaning the rotor, comprising:

a cleaning device movably disposed relative to the rotor, said cleaning device including a wear part in the form of a flexible scraper strip to be positioned in a predetermined position in the fiber collecting groove of the rotor, a reservoir for storing said flexible scraper strip, and a displacement device for frictionally engaging said scraper strip and causing said scraper strip to automatically extend from said reservoir an optimal length independently of its abrasion from wear upon entry of said cleaning device into the rotor, for assuring a secure placement of said scraper strip in the bottom of the fiber collecting groove.

2. The apparatus according to claim 1, wherein said displacement device includes a drive element, a feed roller connected to said drive element, and a spring-biased pressure roller clamping said scraper strip against said feed roller.

3. The apparatus according to claim 2, wherein said drive element is a pneumatic cylinder.

4. The apparatus according to claim 2, wherein said scraper strip has a tip, and said feed roller frictionally engages said scraper strip to force said scraper strip forward towards the rotor, a forward feedpath thereby being limited by contact of said tip in the fiber collecting groove.

5. The apparatus according to claim 2, wherein said displacement device causes said scraper strip to retract into said reservoir, including a stroke limiter acting upon said scraper strip for limiting the retraction of said scraper strip.

6. The apparatus according to claim 5, wherein the extension of said scraper strip is longer than the retraction being influenced by said stroke limiter.

7. The apparatus according to claim 6, wherein said stroke limiter permits said scraper strip to pass said stroke limiter unhindered in the direction of the extension and blocks said scraper strip in the direction of the retraction.

8. The apparatus according to claim 1, including a sensor device for detecting a depletion of said scraper strip reservoir.

9. In an open-end spinning unit including a rotor housing and a rotor revolving in the rotor housing and having a fiber collecting groove formed therein defining a groove bottom, an apparatus for cleaning the rotor, comprising:

a reservoir;

a cleaning device having a wear part constructed as a flexible scraper part being kept in reserve in said reservoir for positioning in a predetermined position in the fiber collecting groove of the rotor; and a displacement device for frictionally engaging said scraper part for extending said scraper part from said reservoir to an optimal length independently of its abrasion from wear upon entry of said cleaning device into the rotor and for assuring a secure placement of said scraper part in the bottom of the fiber collecting groove.

* * * * *